US008066475B2

(12) United States Patent
Bulgrin et al.

(10) Patent No.: US 8,066,475 B2
(45) Date of Patent: Nov. 29, 2011

(54) LABYRINTH COMPRESSION SEAL AND TURBINE INCORPORATING THE SAME

(75) Inventors: Charles Alan Bulgrin, Greenville, SC (US); Ralph Chris Bruner, Greenville, SC (US); Robert Craig Akin, Greer, SC (US)

(73) Assignee: General Electric Company, Schenctady, NY (US)

( * ) Notice: Subject to any disclaimer, the term of this patent is extended or adjusted under 35 U.S.C. 154(b) by 1376 days.

(21) Appl. No.: 11/896,533

(22) Filed: Sep. 4, 2007

(65) Prior Publication Data

US 2009/0058013 A1 Mar. 5, 2009

(51) Int. Cl.
*F01D 11/02* (2006.01)

(52) U.S. Cl. ..... 415/168.4; 415/174.5

(58) Field of Classification Search ..... 415/168.3, 415/168.4, 171.1, 173.7, 174.4, 174.5
See application file for complete search history.

(56) References Cited

U.S. PATENT DOCUMENTS

| | | | | |
|---|---|---|---|---|
| 3,945,758 | A * | 3/1976 | Lee | 415/144 |
| 4,113,406 | A * | 9/1978 | Lee et al. | 415/115 |
| 4,273,510 | A * | 6/1981 | Ambrosch et al. | 415/119 |
| 4,420,161 | A * | 12/1983 | Miller | 277/418 |
| 5,088,889 | A * | 2/1992 | Wolff | 415/171.1 |
| 6,588,764 | B2 | 7/2003 | Fuller | |
| 7,004,475 | B2 | 2/2006 | McHale et al. | |

* cited by examiner

*Primary Examiner* — Nathaniel Wiehe
(74) *Attorney, Agent, or Firm* — Nixon & Vanderhye PC

(57) ABSTRACT

A uniquely configured rotating seal tooth is used in conjunction with commonly used labyrinth-type seals that provide a seal between a rotating component and a stationary component. The uniquely configured rotating seal tooth produces a compression mechanism to counter leakage flow through the labyrinth of seal teeth, thereby lessening the pressure gradient that drives leakage and reversing the direction of some of the leakage flow.

10 Claims, 3 Drawing Sheets

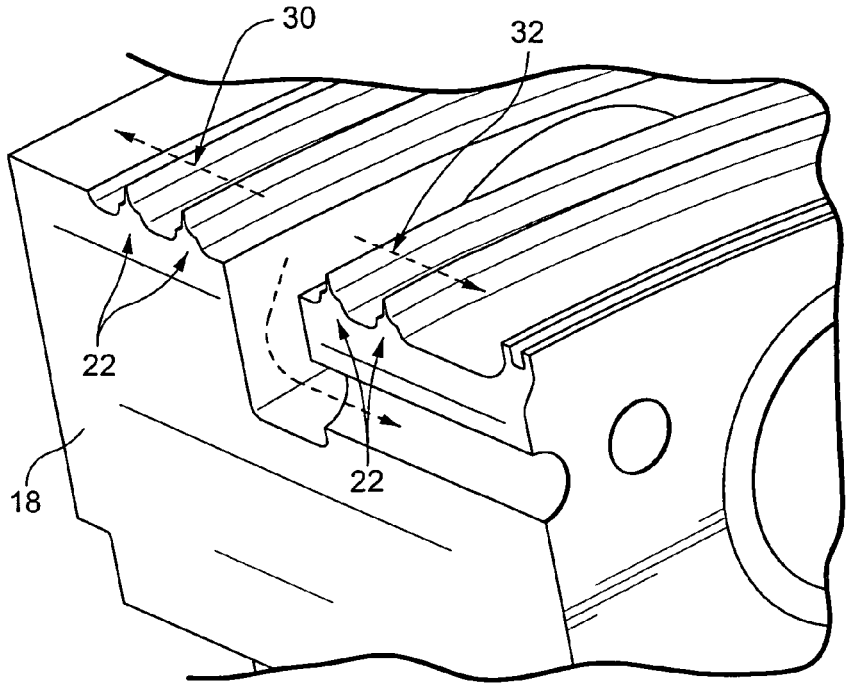
Fig. 2 (PRIOR ART)
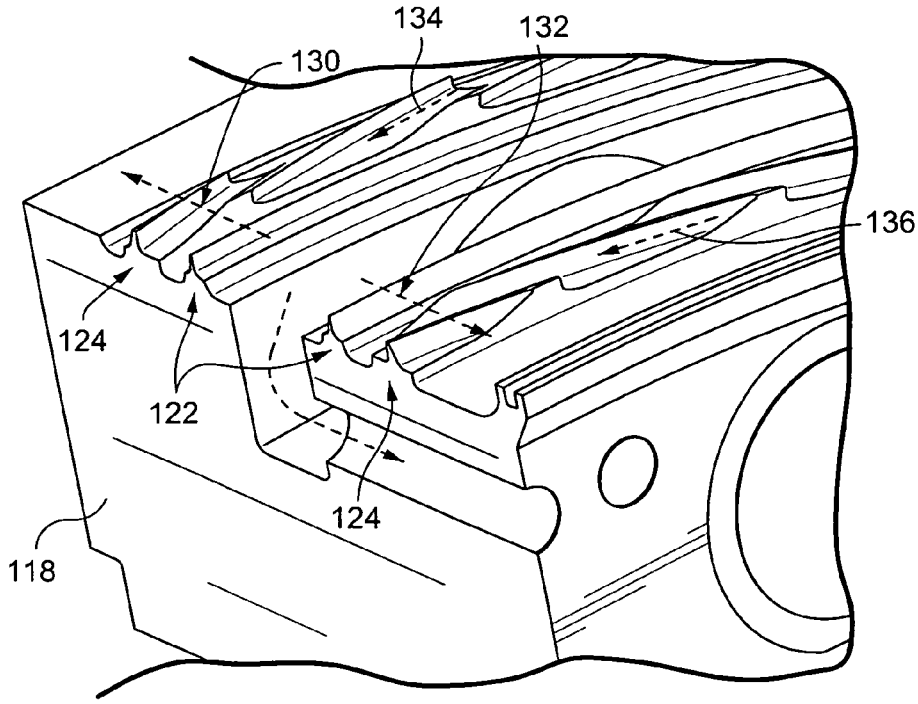
Fig. 3

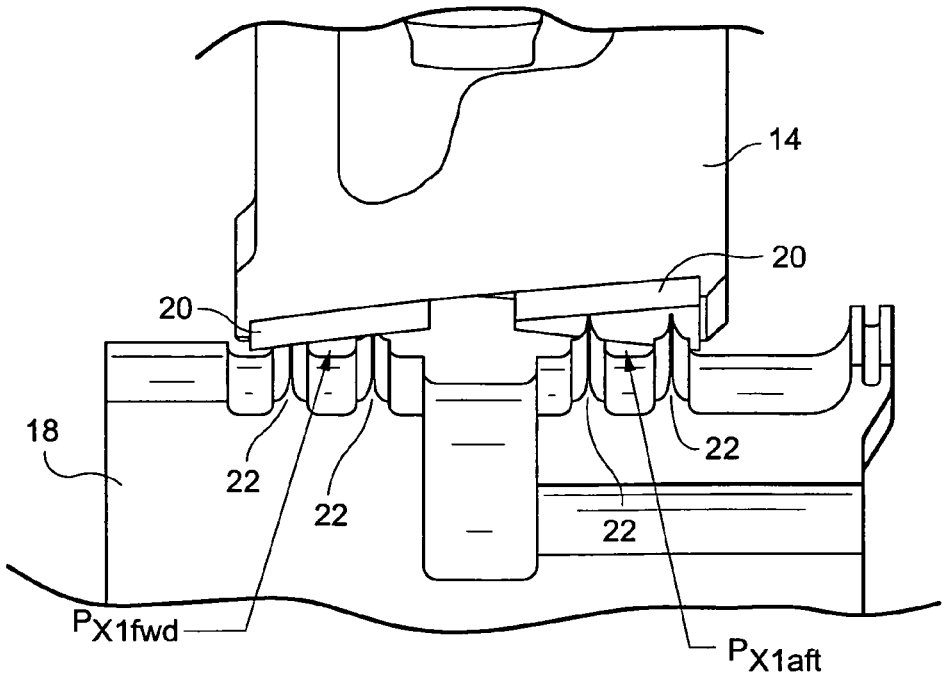
Fig. 4 (PRIOR ART)
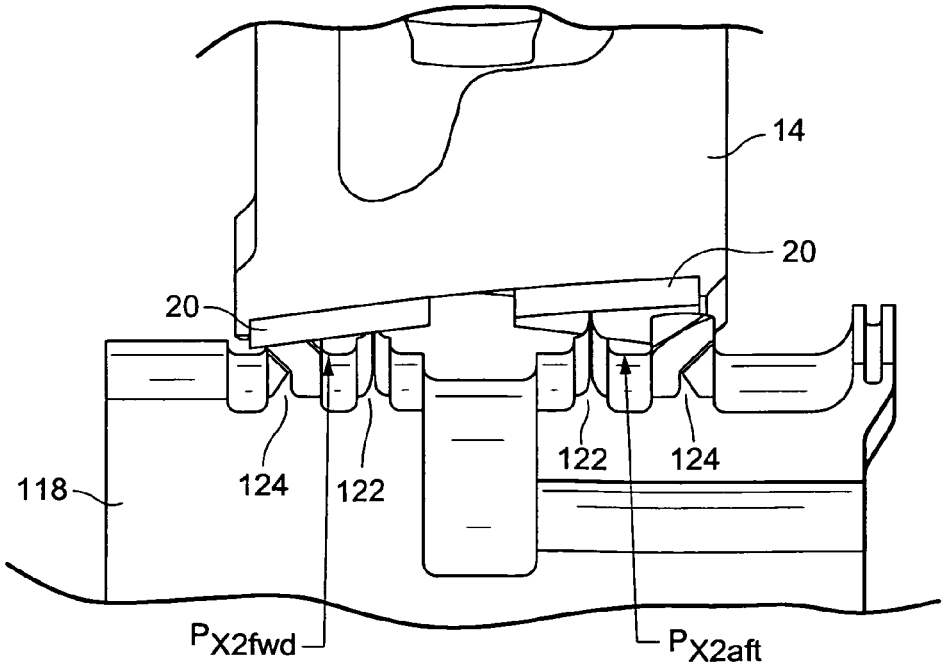
Fig. 5

LABYRINTH COMPRESSION SEAL AND TURBINE INCORPORATING THE SAME

BACKGROUND OF THE INVENTION

The present invention relates to a unique seal structure for improving axial sealing of secondary air flow in the wheel spaces of gas turbines.

Obtaining high performance levels in a gas turbine requires minimizing leakages of secondary air throughout the wheel spaces. This presents a challenge since the sealing mechanism must be devised to provide a means to effectively seal between rotating components (buckets/blades/disks/spacers) and stationary components (nozzles/vanes/diaphragms). It is common practice to use labyrinth type seals which restrict the area where the leakage might occur and also create a series of pressure loss mechanisms to further reduce the flow of air leakage. Different arrangements of labyrinth seal teeth have been used, some aligned circumferentially, some staggered circumferentially. Also, different numbers of seal teeth are commonly used in series to provide additional pressure losses and further reduce leakage when needed.

The labyrinth seal teeth can be designed to interfere with and cut into the opposing wall, which is usually honeycomb or an alternative abradable material, to provide a minimal gap and leakage area during operation. However, most large gas turbines experience additional closure during hot start-up transients which results in the seal teeth cutting deeper into the abradable wall during the transient start but then opening to expose an enlarged gap during steady state operation.

Another method to seal between the rotating and stationary components used along with labyrinth seals is to install brush seals in series. Brush seals can further reduce leakages, but they are costly and increase the complexity of the gas turbine. Also, there is a limited length that the brush seal bristles can be extended beyond the housing that contains them, and if the transient closure is too large, brush seals cannot be used without risk of a hard rub between the brush seal housing and the rotating components.

BRIEF DESCRIPTION OF THE INVENTION

The invention provides a unique means to improve axial sealing of secondary air flow in the wheel spaces of gas turbines. As presently proposed, it is used in conjunction with commonly used labyrinth-type seals that provide a seal between a rotating component and a stationary component. More specifically, the invention introduces a uniquely configured rotating seal tooth which produces a compression mechanism to counter leakage flow through the labyrinth of seal teeth, thereby lessening the pressure gradient that drives leakage and reversing the direction of some of the leakage flow.

Thus, the invention may be embodied in a labyrinth seal for a turbine having a stationary housing through which extends a rotating element wherein the turbine includes media flow regions of differential pressure, the labyrinth seal comprising a first seal assembly comprising a first plurality of adjacent seal components extending generally radially from one of 1) a portion of the stationary housing and 2) a portion of the rotating element, said first plurality of seal components including at least one first seal fin structure and a second seal fin structure, said first seal fin structure comprising at least one circumferentially extending fin, said second seal fin structure comprising a plurality of circumferentially adjacent seal fins, each inclined at an angle with respect to said at least one circumferentially extending fin and spaced therefrom to define a circumferentially extending dam gap therebetween.

The invention may also be embodied in a turbine having a stationary housing through which extends a rotating element, wherein the turbine includes media flow regions of differential pressure, and a labyrinth seal comprising a first seal assembly comprising a first plurality of adjacent seal components extending generally radially from one of 1) a portion of the stationary housing and 2) a portion of the rotating element, said first plurality of seal components including at least one first seal fin structure and a second seal fin structure, said first seal fin structure comprising at least one circumferentially extending fin, said second seal fin structure comprising a plurality of circumferentially adjacent seal fins, each inclined at an angle with respect to said at least one circumferentially extending fin and spaced therefrom to define a circumferentially extending dam gap therebetween.

BRIEF DESCRIPTION OF THE DRAWINGS

These and other objects and advantages of this invention, will be more completely understood and appreciated by careful study of the following more detailed description of the presently preferred example embodiments of the invention taken in conjunction with the accompanying drawings, in which:

FIG. 2 is a perspective view of a portion of a conventional spacer seal tooth configuration;

FIG. 3 is a perspective view of a spacer seal bladed tooth configuration embodying the invention;

FIG. 4 is a circumferential view partly in cross-section of a conventional spacer seal tooth configuration; and FIG. 5 is a circumferential view partly in cross-section of a spacer seal bladed tooth configuration embodying the invention.

DETAILED DESCRIPTION OF THE INVENTION

Figure 1:
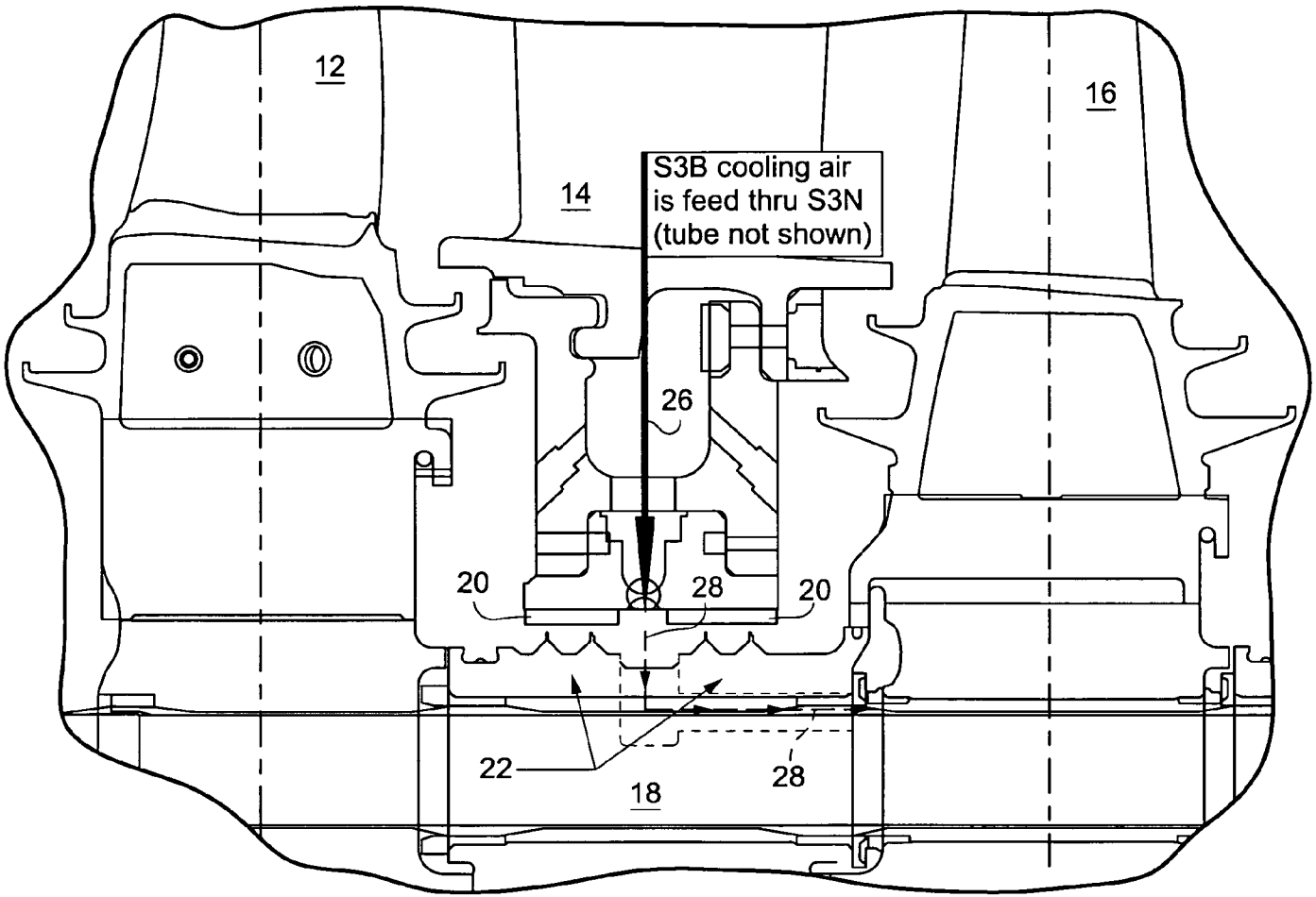
FIG. 1 is a schematic cross-sectional view, partly broken away of a gas turbine illustrating a conventional labyrinth-type seal.

In an embodiment of the invention, a unique structure is provided to improve axial sealing of secondary air flow in the wheel spaces of gas turbines. As presently proposed, it is used in conjunction with commonly used labyrinth-type seals that provide a seal between a rotating component and a stationary component. More specifically, the invention introduces a uniquely configured rotating seal tooth which produces a compression mechanism to counter leakage flow through the labyrinth of seal teeth, thereby lessening the pressure gradient that drives leakage and reversing the direction of some of the leakage flow.

In an example embodiment, the present invention avoids the cost, complexities and risks associated with brush seals by reconfiguring the shape and arrangement of labyrinth teeth to create a compression or reverse pumping of the leakage flow. Thus, unlike like brush seals, according to an aspect of the invention does not add additional components. Instead, features comprising the invention are machined into the rotating component along with the conventional labyrinth seal teeth. Although additional machining is involved, it is significantly less effort then would be involved in the manufacture and installation of brush seals. Moreover, since brush seals wear out and easily suffer from handling damage, the invention is considerably more durable and reliable then conventional brush seals particularly provided to augment labyrinth seals.

In an example embodiment, the invention proposes to modify the machining process of the rotating component to produce a series of repetitive circumferential seal teeth that have a shallow angle of inclination relative to the circumferential path of the rotating component. The precise machining of these repetitively inclined seal teeth essentially forms shallow height blades that act similarly to compressor blades or impeller blades. However, unlike a typical blade or impeller stage having the intent to maximize flow, the bladed seal teeth are used in conjunction with one or more conventional seal teeth. This is done in order to produce small volumes of flow, opposite in direction to leakage flow, to dam up the flow to produce a locally increased annular pressure region infused with a conventional seal tooth to counteract the leakage flow as described more fully below.

As will be understood, the herein described embodiment of invention offers several advantages over current labyrinth seal arrangements, with or without brush seals. First it has the potential to significantly reduce secondary flow leakages within the wheel spaces. Commonly labyrinth seals are used between all stages in the turbine section of a gas turbine. Therefore, the invention can provide a potential enhancement to all stages of gas turbine. Furthermore, the concept of the invention can be applied to ground based industrial turbines, marine and aircraft engines, and also steam turbines. Moreover, it potentially offers significant cost savings and simplification of hardware for systems currently using brush seals.

In an example embodiment, the invention will be described as associated with GE 9H combined cycle gas turbine, installed to lower costs and improve the sealing between the third stage nozzle and the 2-3 spacer in the wheelspace which lies radially inboard of the nozzle. The static nozzle component has honeycomb attached to its inside radius and the rotating 2-3 spacer has the seal teeth machined on its outside diameter. However, the invention is not to be limited to the illustrated example embodiment.

Referring more particularly to the schematic illustration of FIG. 1, a conventional 9H design is illustrated in part showing the stage 2 bucket 12, the stage 3 nozzle 14 and the stage 3 bucket 16. At the interface of the third stage nozzle and the 2-3 spacer 18, honeycomb material 20 is attached to the inside radius of the static third stage nozzle component 14 and, in the illustrated conventional structure, the rotating 2-3 spacer 18 has conventional, circumferential labyrinth seal teeth 22 machined on its outside diameter. The labyrinth seal teeth are provided to minimize leakage of the stage 3 bucket cooling air fed through the stage 3 nozzle as schematically illustrated by arrows 26,28.

FIG. 2 is a perspective view of a portion of the 2-3 spacer 18 illustrating the first and second circumferentially extending seal teeth 22 machined on each of the upstream and downstream sides of the cooling air flow passage. Arrows 30,32 are included in FIG. 3 to illustrate the leakage direction toward the stage 2 bucket aft wheel space and the leakage direction toward the stage 3 bucket forward wheel space, respectively.

FIG. 3 is a view similar to FIG. 2 but illustrating bladed teeth 124 machined in the outer surface of the 2-3 spacer 118 according to an example embodiment of the invention. As illustrated therein a series of repetitive part circumferential seal teeth 124 are provided that are disposed at an angle relative to the circumferential path of the rotating component and, thus at an angle to the conventional seal teeth 122. As understood from the illustrated embodiment, the bladed seal teeth 124 do not entirely replace the conventional circumferential seal teeth 122 but rather are used in conjunction with one or more conventional seal teeth 122. As illustrated in FIGS. 3, 4 and 5, this is done in order to produce small volumes 134,136 of flow between the inclined seal teeth 124 flowing in a direction opposite to the leakage flow 130,132 thereby increasing the pressure on the axially outer side of the associated circumferential seal tooth 122 with respect to the coolant passage to dam up the flow to produce a local increased annular pressure regions $P_{X2fwd}$ and $P_{X2aft}$ in series with the respective conventional seal tooth 122 to counteract the leakage flow 130,132, respectively. Thus, the pressure $P_{X2fwd}$ and $P_{X2aft}$, respectively, adjacent the conventional seal tooth 122 illustrated in FIG. 5 is greater than the pressure $P_{X1fwd}$ and $P_{X1aft}$, respectively, between adjacent pairs of conventional seal teeth 22 as illustrated in FIG. 4. As illustrated in FIG. 5, the bladed seal teeth 124 are inclined in opposite directions on the upstream and downstream sides of the area being sealed to respectively oppose the leakage flow axially upstream and downstream therefrom.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A labyrinth seal for a turbine having a stationary housing through which extends a rotating element wherein the turbine includes media flow regions of differential pressure, the labyrinth seal comprising:

a first seal assembly comprising a first plurality of adjacent seal components extending generally radially from one of 1) a portion of the stationary housing and 2) a portion of the rotating element, said first plurality of seal components including at least one first seal fin structure and a second seal fin structure, said first seal fin structure comprising at least one circumferentially extending fin, said second seal fin structure comprising a plurality of circumferentially adjacent seal fins, each inclined at an angle with respect to said at least one circumferentially extending fin and spaced therefrom to define a circumferentially extending dam gap therebetween, and a second seal assembly comprising a second plurality of adjacent seal components extending generally radially from one of 1) a portion of the stationary housing and 2) a portion of the rotating element, said second plurality of seal components including at least one first seal fin structure and a second seal fin structure, said first seal fin structure comprising at least one circumferentially extending fin, said second seal fin structure comprising a plurality of circumferentially adjacent seal fins, each inclined at an angle with respect to said at least one circumferentially extending fin and spaced therefrom to define a circumferentially extending dam gap therebetween, wherein a cooling media passage is defined between said first and second seal assemblies, said at least one circumferential seal fin of each said seal assembly being disposed between said second seal fin structure thereof and said cooling media passage.

2. A labyrinth seal as in claim 1, comprising a plurality of nozzles fixed to said housing part and a plurality of buckets secured to said rotating element and wherein said first seal assembly is defined on a seal ring disposed between adjacent buckets and radially inwardly of a nozzle disposed between said buckets, and wherein said cooling media passage includes a cooling passage defined through said nozzle in communication with a coolant passage defined in said seal ring.

3. A labyrinth seal as in claim 1, wherein said plurality of circumferentially adjacent seal fins of each said second seal fin structure are inclined at an angle so as to direct flow towards said respective dam gap upon rotation of said rotatable part.

4. A labyrinth for a turbine having a stationary housing through which extends a rotating element wherein the turbine includes media flow regions of differential pressure, the labyrinth seal comprising:

a first seal assembly comprising a first plurality of adjacent seal components extending generally radially from one of 1) a portion of the stationary housing and 2) a portion of the rotating element, said first plurality of seal components including at least one first seal fin structure and a second seal fin structure, said first seal fin structure comprising at least one circumferentially extending fin, said second seal fin structure comprising a plurality of circumferentially adjacent seal fins, each inclined at an angle with respect to said at least one circumferentially extending fin and spaced therefrom to define a circumferentially extending dam gap therebetween, and a second seal assembly comprising a second plurality of adjacent seal components extending generally radially from one of 1) a portion of the stationary housing and 2) a portion of the rotating element, said second plurality of seal components including at least one first seal fin structure and a second seal fin structure, said first seal fin structure comprising at least one circumferentially extending fin, said second seal fin structure comprising a plurality of circumferentially adjacent seal fins, each inclined at an angle with respect to said at least one circumferentially extending fin and spaced therefrom to define a circumferentially extending dam gap therebetween, and further comprising a plurality of nozzles fixed to said housing part and a plurality of buckets secured to said rotating element, wherein said first seal assembly is defined on a seal ring disposed between adjacent buckets and radially inwardly of a nozzle disposed between said buckets, and wherein a cooling passage is defined through said nozzle in communication with coolant passage defined in said seal ring, wherein said coolant passage in said seal ring is defined between said first and second seal assemblies, said at least one circumferential seal fin of each said seal assembly being disposed between said second seal fin structure thereof and said coolant passage.

5. A labyrinth seal as in claim 4, wherein said plurality of circumferentially adjacent seal fins of each said second seal fin structure are inclined at an angle so as to direct flow towards said dam gap upon rotation of said rotatable part.

6. A turbine having a stationary housing through which extends a rotating element, wherein the turbine includes media flow regions of differential pressure, and a labyrinth seal comprising:

a first seal assembly comprising a first plurality of adjacent seal components extending generally radially from one of 1) a portion of the stationary housing and 2) a portion of the rotating element, said first plurality of seal components including at least one first seal fin structure and a second seal fin, said first seal fin structure comprising at least one circumferentially extending fin structure, said second seal fin structure comprising a plurality of circumferentially adjacent seal fins, each inclined at an angle with respect to said at least one circumferentially extending fin and spaced therefrom to define a circumferentially extending dam gap therebetween, and.

a second seal assembly comprising a second plurality of adjacent seal components extending generally radially from one of 1) a portion of the stationary housing and 2) a portion of the rotating element, said second plurality of seal components including at least one first seal fin structure and a second seal fin structure, said first seal fin structure comprising at least one circumferentially extending fin, said second seal fin structure comprising a plurality of circumferentially adjacent seal fins, each inclined at an angle with respect to said at least one circumferentially extending fin and spaced therefrom to define a circumferentially extending dam gap therebetween, wherein a cooling media passage is defined between said first and second seal assemblies, said at least one circumferential seal fin of each said seal assembly being disposed between said second seal fin structure thereof and said cooling passage.

7. A turbine as in claim 6, comprising a plurality of nozzles fixed to said housing part and a plurality of buckets secured to said rotating element and wherein said first seal assembly is defined on a seal ring disposed between adjacent buckets and radially inwardly of a nozzle disposed between said buckets, and wherein said cooling media passage includes a cooling passage defined through said nozzle in communication with a coolant passage defined in said seal ring.

8. A turbine as in claim 6, wherein said plurality of circumferentially adjacent seal fins of each said second seal fin structure are inclined at an angle so as to direct flow towards said respective dam gap upon rotation of said rotatable part.

9. A turbine having a stationary housing through which extends a rotating element wherein the turbine includes media flow regions of differential pressure, the labyrinth seal comprising:

a first seal assembly comprising a first plurality of adjacent seal components extending generally radially from one of 1) a portion of the stationary housing and 2)a portion of the rotating element, said first plurality of seal components including at least one first seal fin structure and a second seal fin structure, said first seal fin structure comprising at least one circumferentially extending fin, said second seal fin structure comprising a plurality of circumferentially adjacent seal fins, each inclined at an angle with respect to said at least one circumferentially extending fin and spaced therefrom to define a circumferentially extending dam gap therebetween, and a second seal assembly comprising a second plurality of adjacent seal components extending generally radially from one of 1) a portion of the stationary housing and 2) a portion of the rotating element, said second plurality of seal components including at least one first seal fin structure and a second seal fin structure, said first seal fin structure comprising at least one circumferentially extending fin, said second seal fin structure comprising a plurality of circumferentially adjacent seal fins, each inclined at an angle with respect to said at least one circumferentially extending fin and spaced therefrom to define a circumferentially extending dam gap therebetween, and further comprising a plurality of nozzles fixed to said housing part and a plurality of buckets secured to said rotating element, wherein said first seal and second seal assemblies are defined on a seal ring disposed between adjacent buckets and radially inwardly of a nozzle disposed between said buckets, wherein a cooling passage is defined through said nozzle in communication with a coolant passage defined in said seal ring and wherein said coolant passage in said seal ring is defined between said first and second seal assemblies, said at least one circumferential seal fin of each said seal assembly being disposed between said second seal fin structure thereof and said coolant passage.

10. A turbine as in claim 9, wherein said plurality of circumferentially adjacent seal fins of each said second seal fin structure are inclined at an angle so as to direct flow towards said dam gap upon rotation of said rotatable part.

* * * * *

UNITED STATES PATENT AND TRADEMARK OFFICE

CERTIFICATE OF CORRECTION

PATENT NO. : 8,066,475 B2
APPLICATION NO. : 11/896533
DATED : November 29, 2011
INVENTOR(S) : Bulgrin et al.

It is certified that error appears in the above-identified patent and that said Letters Patent is hereby corrected as shown below:

In the Claims:

In Claim 4 at column 5, line 9, delete “A labyrinth for” and insert --A labyrinth seal for--

In Claim 4 at column 5, line 48, delete “with coolant” and insert --with a coolant--

In Claim 9 at column 6, line 46, delete “the labyrinth seal comprising” and insert --and a labyrinth seal comprising--

Signed and Sealed this
Thirty-first Day of January, 2012

David J. Kappos

David J. Kappos
*Director of the United States Patent and Trademark Office*